US005568758A

United States Patent [19]

Moore

[11] Patent Number: 5,568,758

[45] Date of Patent: Oct. 29, 1996

[54] COMPOUND MITER JIG APPARATUS

[76] Inventor: Danny Moore, Box 2050, Hailey, Id. 83333

[21] Appl. No.: 488,759

[22] Filed: Jun. 8, 1995

[51] Int. Cl.[6] ..... B27B 17/08; B27B 27/08

[52] U.S. Cl. ..... 83/745; 83/522.18; 83/574; 83/581; 83/798

[58] Field of Search ..... 83/522.18, 522.25, 83/574, 745, 581, 794, 796, 798; 30/371–376, 381–387; 33/630, 640

[56] References Cited

U.S. PATENT DOCUMENTS

| | | | |
|---|---|---|---|
| 3,810,408 | 5/1974 | Taira et al. | 83/802 |
| 3,967,378 | 7/1976 | Arff et al. | 30/383 |
| 4,233,739 | 11/1980 | Hinrichs | 30/383 |
| 4,545,122 | 10/1985 | Durfee, Jr. | 30/383 |
| 4,561,186 | 12/1985 | Keefe . | |
| 4,611,521 | 9/1986 | McCardle | 83/574 X |
| 4,685,369 | 8/1987 | Beamer | 83/581 X |
| 4,726,274 | 2/1988 | Pitoni et al. | 83/745 |
| 4,854,206 | 8/1989 | Wilfong | 83/745 |
| 4,951,398 | 8/1990 | Bennett et al. | 33/630 |

*Primary Examiner*—Eugenia Jones

[57] ABSTRACT

A compound miter jig apparatus includes a base unit and a plurality of connectors for connecting the base unit to an article to be cut. A pair of pivot support assemblies arc connected to the base unit. The pivot support assemblies are spaced apart from each other on the base unit and include longitudinally adjustable first pivot elements. A bearing block assembly is supported by the first pivot elements and is located between the first pivot elements. The bearing block assembly includes a pair of second pivot elements in contact with the first pivot elements. The bearing block assembly also includes a shaft bearing assembly. A shaft assembly is supported by the shaft bearing assembly. The shaft assembly includes a chain-saw-connector assembly. An adjustable tilt-lock assembly is supported by the base unit and is connected to the bearing block assembly for locking the bearing block assembly at a predetermined angular tilt. The base unit includes a component-support portion which supports the pair of pivot support assemblies and the lock block and may include a base extension portion which extends away from the component-support portion.

11 Claims, 4 Drawing Sheets

FIG 1
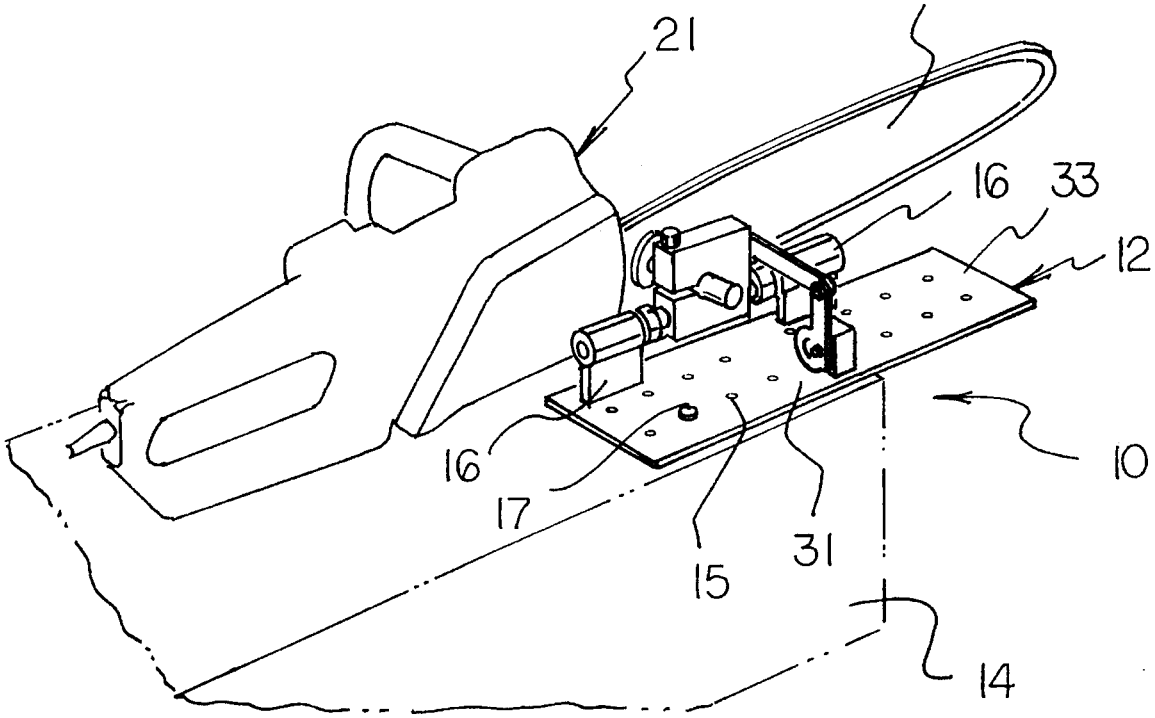
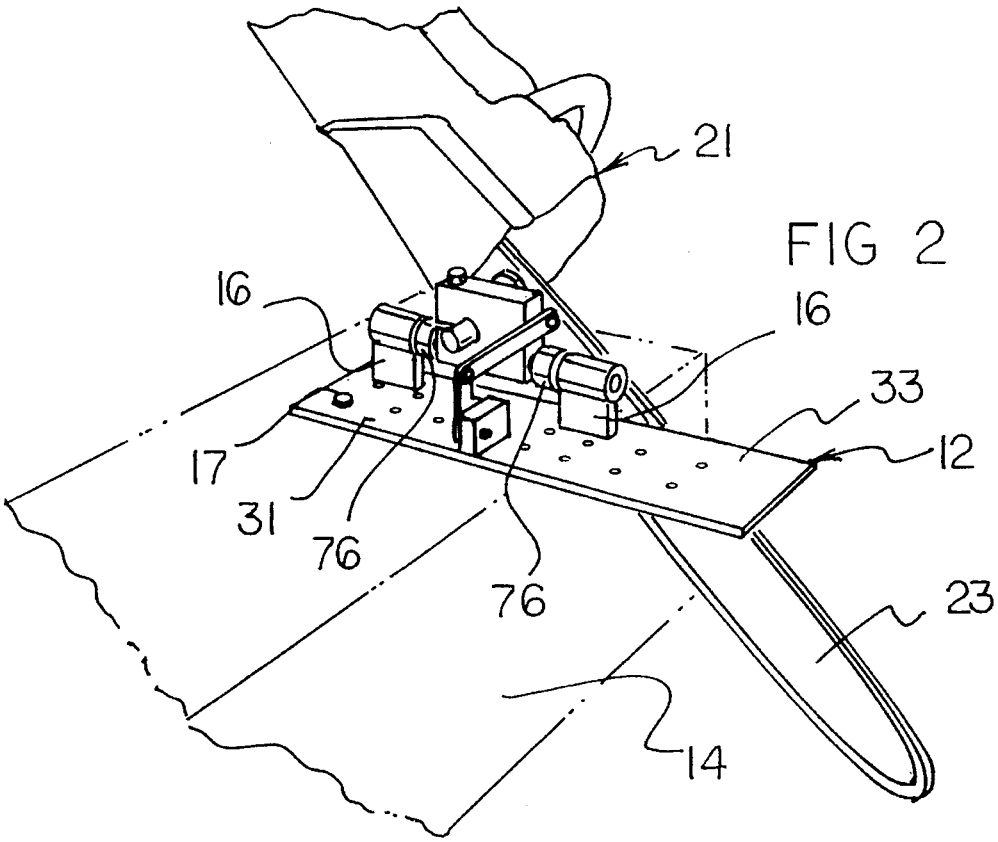
FIG 2

FIG 5
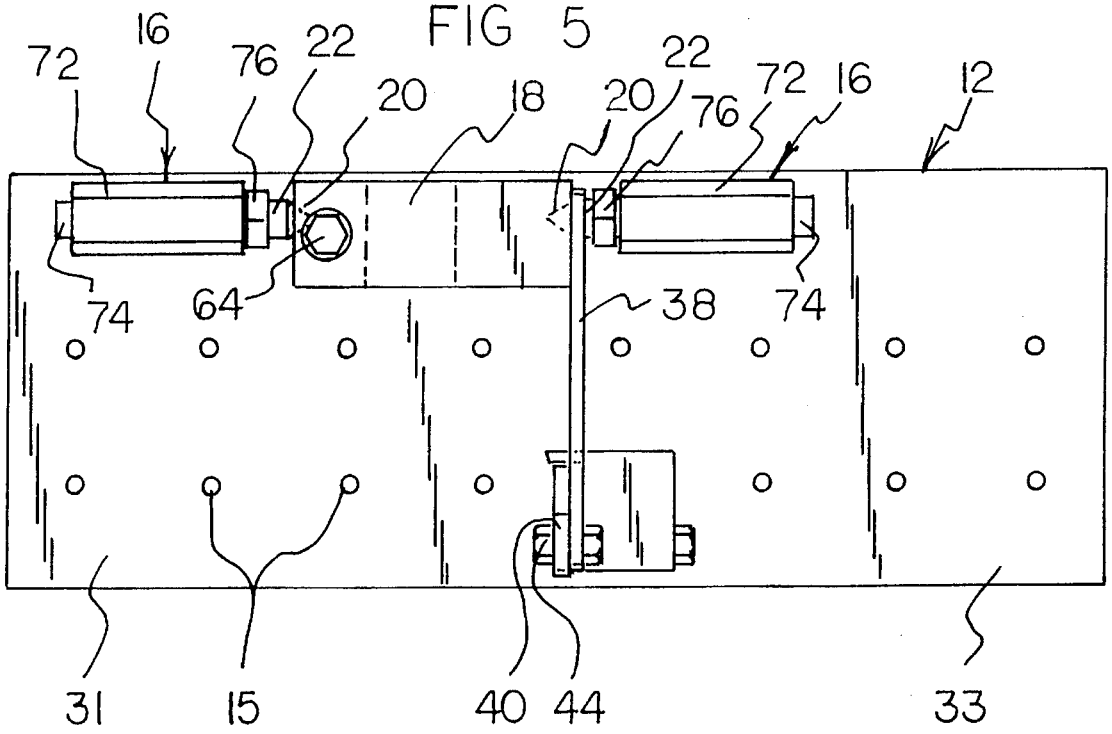
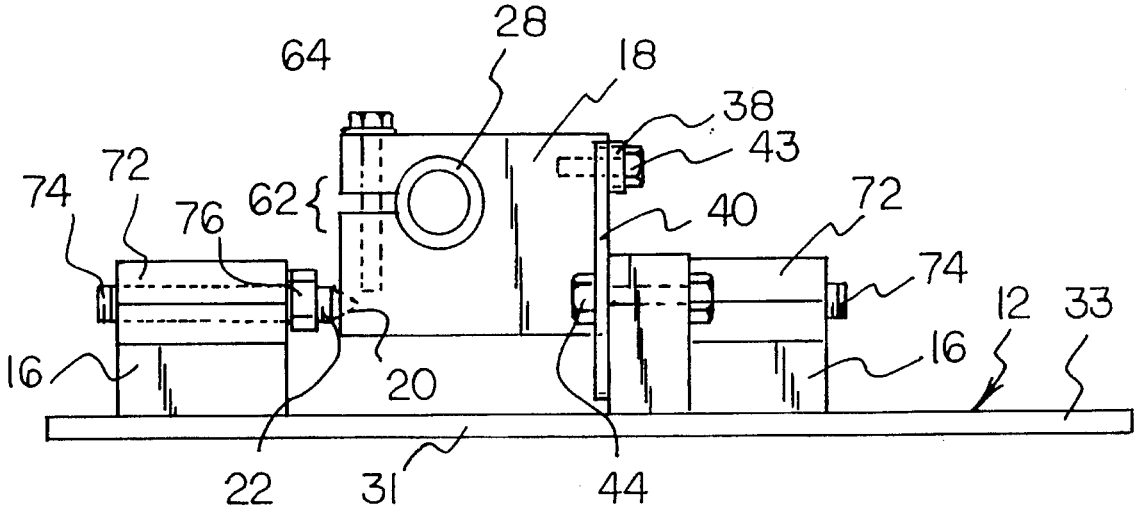
FIG 6

COMPOUND MITER JIG APPARATUS

BACKGROUND OF THE INVENTION

1. Field of the Invention

The present invention relates generally to miters and, more particularly, to miters especially adapted for use with chain saws.

2. Description of the Prior Art

Hand-held chain saws are very useful cutting implements. In one mode of use, a chain saw is held and guided by a user's hands. In a second mode of use, a chain saw can be guided in its cutting my a mechanical guide. Throughout the years, a number of innovations have been developed relating to mechanical guides for chain saws, and the following U.S. patents are representative of some of those innovations: U.S. Pat. Nos. 4,233,739; 4,545,122; 4,561,186, and 4,951,398.

More specifically, U.S. Pat. Nos. 4,233,739, 4,545,122, and 4,561,186 disclose devices that attach to a handle of a chain saw, that extend out from the handle along an axis that is parallel to a longitudinal axis of a timber to be cut, and that guide the chain saw in a cut that is perpendicular to the longitudinal axis of the timber. Such devices do not guide the chain saw in cutting the timber in a range of acute angles that are not perpendicular to the longitudinal axis of the timber. Moreover, such devices do not guide the chain saw in partial cuts through the timber. That is, such devices do not provide a guide for controlling cutting with the chain saw half-way through a timber. Finally, such devices do not guide a chain saw so that the end of a timber can be cut in the form of a tenon.

In view of the above, it would be desirable if a guide device were provided for a chain saw that guides the chain saw in a range of non-perpendicular angles with respect to a longitudinal axis of a timber to be cut. Also, it would be desirable if a guide device for a chain saw were provided which guides the chain saw for partially cutting through ends of a timber. In addition, it would be desirable if a guide device for a chain saw were provided that guides the chain saw for producing a tenon at the end of a timber.

U.S. Pat. No. 4,951,398 discloses a measuring and guiding attachment for a chain saw that attaches to the handle of the chain saw. Large timbers are relatively massive compared to chain saws. Therefore, large timbers are less easily jarred or moved than chain saws. This being the case, if a guide for a chain saw were attached to a large timber, the guide would be more stable than one attached to the chain saw. Therefore, it would be desirable if a guide device for a chain saw were provided that readily attaches to a large timber.

U.S. Pat. Nos. 3,810,408 and 3,967,378 may be of interest for their disclosure of chain guides for chain saws.

Still other features would be desirable in a guide apparatus for a chain saw. Chain saws have guide frames for guiding the path of the chain. The guide frames generally have one or more holes therethrough so that various items can be attached to the guide frames. To provide good leverage for the chain saw, it would be desirable if the guide frame had a hole in the proximity of the drive mechanism for the chain. In this respect, it would be desirable if a cutting guide device for chain saw could connect to the hole in the guide frame that is in the proximity of the drive mechanism for the chain.

As mentioned above, it would be desirable if a cutting guide for a chain saw could be used to form a tenon at the end of a timber. Further in this regard, it would be desirable if a cutting guide for a chain saw could be used to provide tenons of a variety of lengths and a variety of thicknesses.

Thus, while the foregoing body of prior art indicates it to be well known to use guides for guiding a chain saw during cutting, the prior art described above does not teach or suggest a chain saw cutting guide apparatus which has the following combination of desirable features: (1) guides the chain saw in a range of non-perpendicular angles with respect to a longitudinal axis of a timber to be cut; (2) guides the chain saw for partially cutting through ends of a timber; (3) guides the chain saw for producing a tenon at the end of a timber; (4) readily attaches to a large timber; (5) connects to a hole in the guide frame that is in the proximity of the drive mechanism for the chain; and (6) can be used to provide tenons of a variety of lengths and a variety of thicknesses. The foregoing desired characteristics are provided by the unique compound miter jig apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a compound miter jig apparatus which includes a base unit and a plurality of connectors for connecting the base unit to an article to be cut. A pair of pivot support assemblies is connected to the base unit. The pivot support assemblies are spaced apart from each other on the base unit and include longitudinally adjustable first pivot elements. A bearing block assembly is supported by the first pivot elements and is located between the first pivot elements. The bearing block assembly includes a pair of second pivot elements in contact with the first pivot elements. The bearing block assembly also includes a shaft bearing assembly.

A shaft assembly is supported by the shaft bearing assembly. The shaft assembly includes a chain-saw-connector assembly. An adjustable tilt-lock assembly is supported by the base unit and is connected to the bearing block assembly for locking the bearing block assembly at a predetermined angular tilt.

The connectors include a plurality of orifices in the base unit, and a plurality of fasteners which are passed through the orifices and into the article. The first pivot elements include conical first pivot bearing surfaces, and the second pivot elements include second bearing surfaces which are complementarily shaped to contact the first pivot bearing surfaces.

The tilt-lock assembly includes a first link which is pivotally connected to the bearing block assembly. A second link is pivotally connected to the first link. A lock block is pivotally connected to the second link. A lock bolt is connected to the lock block and contacts the second link, so that, by screwing the lock bolt into the lock block, the second link is fixed to a predetermined position with respect to the lock block.

The second link may include a ruled surface, and the lock block includes a pointer element adjacent to the ruled surface for pointing to markings on the ruled surface. The second link includes a guide channel, and the lock block includes a channel cam for riding in the guide channel.

Each of the pivot support assemblies may include a longitudinal adjustment assembly for adjusting the contact of the first pivot elements with the second pivot elements, wherein each longitudinal adjustment assembly includes an internally threaded barrel portion and an externally threaded shaft portion that screws into and out of the barrel portion.

The chain-saw-connector assembly may include a first collar connected to the shaft assembly. A threaded bolt projects from the first collar. A second collar is supported by the threaded bolt, and a lock nut screws onto the threaded bolt.

The bearing block assembly may include a split portion and a compression bolt for controlling clamping pressure for moving ends of the bearing block assembly adjacent to the split portion toward each other.

The base unit includes a component-support portion which supports the pair of pivot support assemblies and the lock block and may include a base extension portion which extends away from the component-support portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved compound miter jig apparatus which has all of the advantages of the prior art and none of the disadvantages.

It is another object of the present invention to provide a new and improved compound miter jig apparatus which may be easily and efficiently manufactured and marketed.

It is a further object of the present invention to provide, a new and improved compound miter jig apparatus which is of durable and reliable construction.

An even further object of the present invention is to provide a new and improved compound miter jig apparatus which is susceptible of a low cost of manufacture with regard to both materials and labor, and which accordingly is then susceptible of low prices of sale to the consuming public, thereby making such compound miter jig apparatus available to the buying public.

Still yet a further object of the present invention is to provide a new and improved compound miter jig apparatus which guides a chain saw in a range of non-perpendicular angles with respect to a longitudinal axis of a timber to be cut.

Still another object of the present invention is to provide a new and improved compound miter jig apparatus that guides a chain saw for partially cutting through ends of a timber.

Yet another object of the present invention is to provide a new and improved compound miter jig apparatus which guides a chain saw for producing a tenon at the end of a timber.

Even another object of the present invention is to provide a new and improved compound miter jig apparatus for a chain saw that readily attaches to a large timber.

Still a further object of the present invention is to provide a new and improved compound miter jig apparatus which connects to a hole in the guide frame of a chain saw that is in the proximity of the drive mechanism for the chain.

Yet another object of the present invention is to provide a new and improved compound miter jig apparatus that can be used for guiding a chain saw to provide tenons of a variety of lengths and a variety of thicknesses.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the compound miter jig apparatus of the invention supporting a chain saw and connected to a large timber parallel to the longitudinal axis of the timber.

FIG. 2 is a perspective view showing a preferred embodiment of the compound miter jig apparatus of the invention supporting a chain saw and connected to a large timber perpendicular to the longitudinal axis of the timber.

FIG. 5 is a top view of the embodiment of the invention shown in FIG. 3.

FIG. 6 is a side view of the embodiment of the invention shown in FIG. 3.

DESCRIPTION OF THE PREFERRED EMBODIMENT

With reference to the drawings, a new and improved compound miter jig apparatus embodying the principles and concepts of the present invention will be described.

Figure 3:
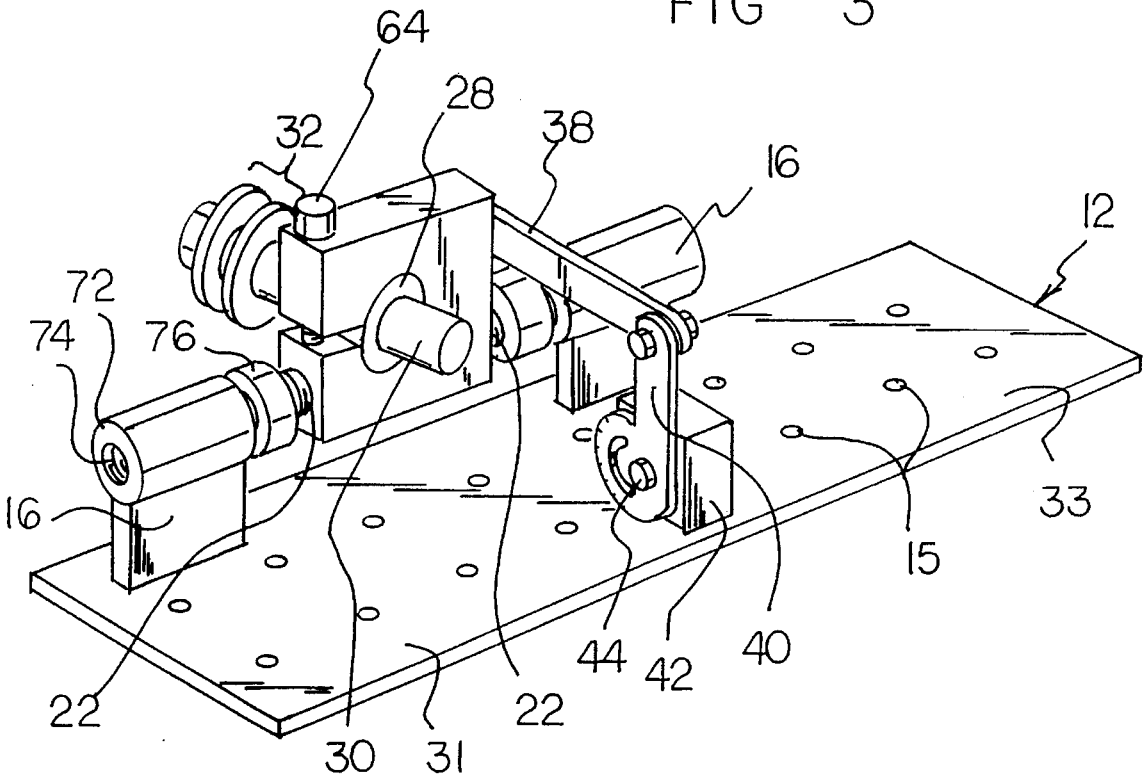
FIG. 3 is an enlarged perspective view of the embodiment of the compound miter jig apparatus of FIGS. 1 and 2 removed from the timber and disconnected from the chain saw.
Figure 4:
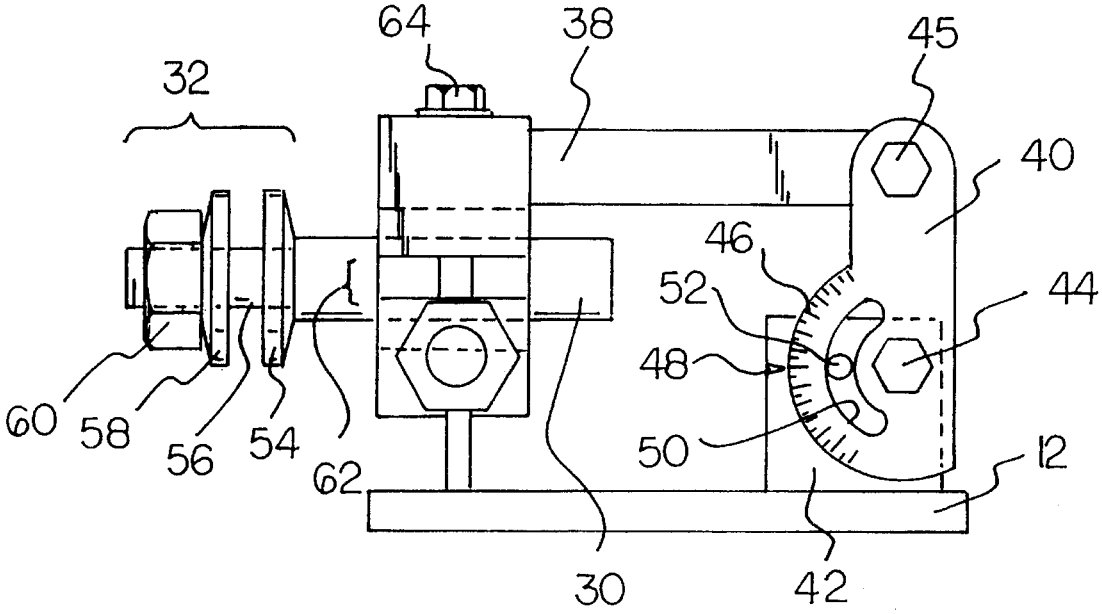
FIG. 4 is an enlarged front view of the embodiment of the invention shown in FIG. 3.
Figure 7:
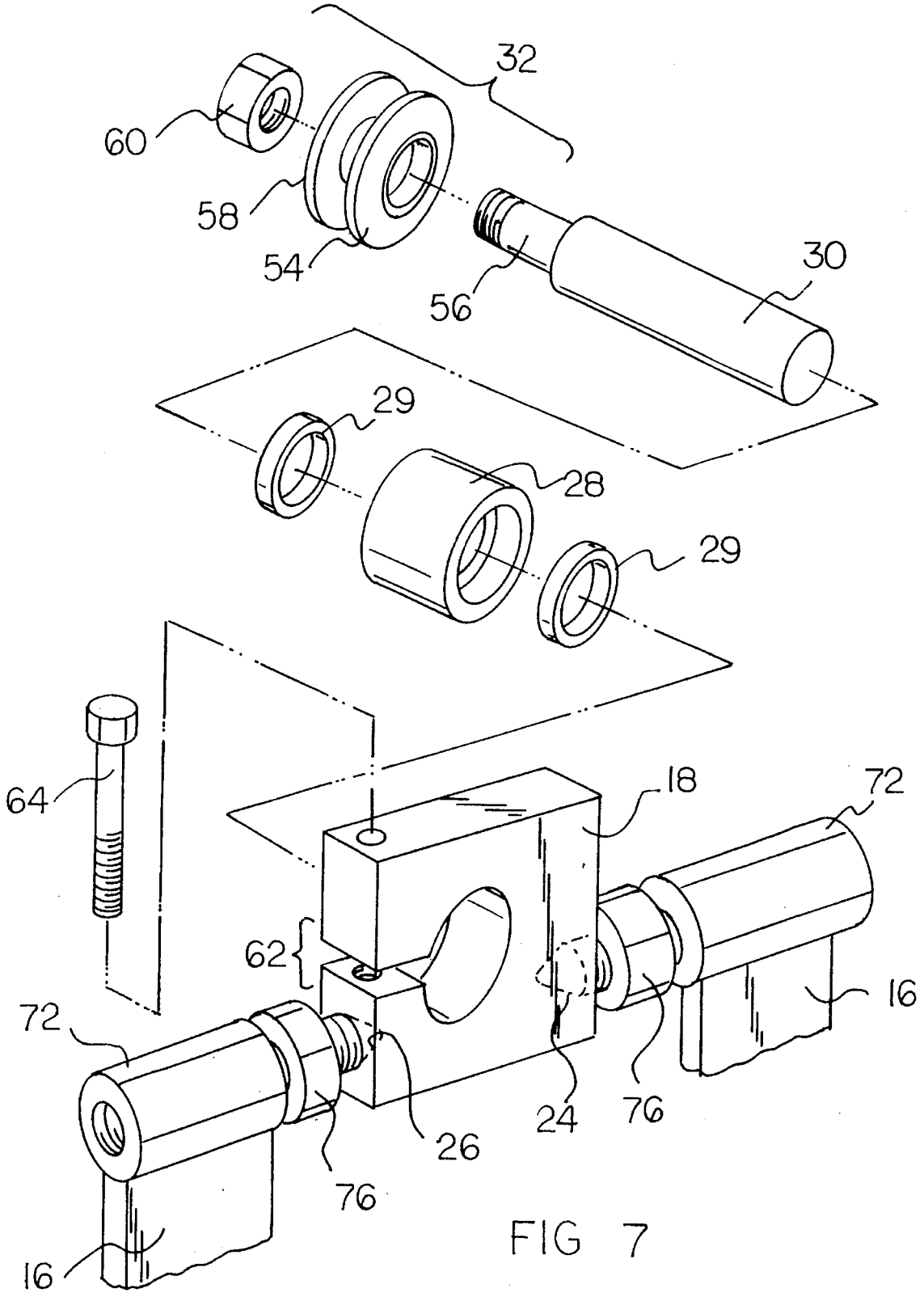
FIG. 7 is a partially exploded view of the embodiment of the invention shown in the above figures.

Turning to FIGS. 1–7, there is shown an exemplary embodiment of the compound miter jig apparatus of the invention generally designated by reference numeral 10. In its preferred form, compound miter jig apparatus 10 includes a base unit 12 and a plurality of connectors for connecting the base unit 12 to an article 14 to be cut. A pair of pivot support assemblies 16 is connected to the base unit 12. The pivot support assemblies 16 are spaced apart from each other on the base unit 12 and include longitudinally adjustable first pivot elements 22. A bearing block assembly 18 is supported by the first pivot elements 22 and is located between the first pivot elements 22. The bearing block assembly 18 includes a pair of second pivot elements 20 in contact with the first pivot elements 22. The bearing block assembly 18 also includes a shaft bearing assembly 28. The shaft bearing assembly 28 is retained in the bearing block assembly 18 by retainers 29.

A shaft assembly 30 is supported by the shaft bearing assembly 28. The shaft assembly 30 includes a chain-saw-connector assembly 32. An adjustable tilt-lock assembly is supported by the base unit 12 and is connected to the bearing block assembly 18 for locking the bearing block assembly 18 at a predetermined angular tilt.

The connectors include a plurality of orifices 15 in the base unit 12, and a plurality of fasteners 17 which are passed through the orifices 15 and into the article 14. The first pivot elements 22 include conical first pivot bearing surfaces 24, and the second pivot elements 20 include second bearing surfaces 26 which are complementarily shaped to contact the first pivot bearing surfaces 24.

The tilt-lock assembly includes a first link 38 which is pivotally connected to the bearing block assembly 18. A second link 40 is pivotally connected to the first link 38. A lock block 42 is pivotally connected to the second link 40. A lock bolt 44 is connected to the lock block 42 and contacts the second link 40, so that, by screwing the lock bolt 44 into the lock block 42, the second link 40 is fixed to a predetermined position with respect to the lock block 42.

A pivotal connection 43 connects the first link 38 to the bearing block assembly 18, and a pivotal connection 45 connects the first link 38 to the second link 40. The second link 40 is connected to the lock block 42 by a pivotal connection around the lock bolt 44 when the lock bolt 44 is loosened from the lock block 42. However, when the lock bolt 44 is tightened into the lock block 42, the connection between the second link 40 and the lock block 42 is locked. This locking effect prevents pivotal action around the pivotal connections 43 and 45 as well. The second link 40 includes a ruled surface 46, and the lock block 42 includes a pointer element 48 adjacent to the ruled surface 46 for pointing to markings on the ruled surface 46. The markings on the ruled surface 46 represent angular degrees of tilt of the bearing block assembly 18.

The second link 40 includes a guide channel 50, and the lock block 42 includes a channel cam 52 for riding in the guide channel 50.

Each of the pivot support assemblies 16 includes a longitudinal adjustment assembly for adjusting the contact of the first pivot elements 22 with the second pivot elements 20 wherein each longitudinal adjustment assembly includes an internally threaded barrel portion 72 and an externally threaded shaft portion 74 that screws into and out of the barrel portion 72. Lock nuts 76 are provided for locking the shaft portions 74 into selected positions with respect to the barrel portions 72.

The chain-saw-connector assembly 32 includes a first collar 54 connected to the shaft assembly 30. A threaded bolt 56 projects from the first collar 54. A second collar 58 is supported by the threaded bolt 56, and a lock nut 60 screws onto the threaded bolt 56. To connect a chain saw 21 to the chain-saw-connector assembly 32, the lock nut 60 and the second collar 58 are removed from the threaded bolt 56. The threaded bolt 56 is passed through an orifice on the chain guide portion 23 of the chain saw 21. The second collar 58 and the lock nut 60 are replaced on the threaded bolt 56, and the lock nut 60 is tightened on the threaded bolt 56 to compress and clamp the chain guide portion 23 of the chain saw 21 between the first collar 54 and the second collar 58.

In tilting the bearing block assembly 18, the lock bolt 44 is loosened, and the bearing block assembly 18 is tilted to a desired degree of angular tilt as indicated by the ruled surface 46 pointed to by the pointer element 48. When the desired degree of tilt is obtained, the lock bolt 44 is retightened, thereby fixing the bearing block assembly 18 in the desired degree of tilt.

The bearing block assembly 18 includes a split portion 62 and a compression bolt 64 for controlling clamping pressure for moving ends of the bearing block assembly 18 adjacent to the split portion 62 toward each other. When the compression bolt 64 is turned to relieve pressure on the bearing block assembly 18 at the split portion 62, the shaft bearing assembly 28 can be removed or replaced. Then, the compression bolt 64 can be retightened to secure the shaft bearing assembly 28 in the bearing block assembly 18.

To use the compound miter jig apparatus 10 of the invention to create a tenon at the end of the article 14, which is a timber 14, the base unit 12 is first is connected to the timber 14 with screws 17 with the base unit 12 shown in the orientation shown in FIG. 1. In this orientation, the length of the base unit 12 is parallel to the length of the timber 14. The chain saw 21 is fixed to the chain-saw-connector assembly 32 through an orifice in the chain guide portion 23 of the chain saw so that the chain saw 21 and the shaft assembly 30 rotate together, with the shaft assembly 30 rotating in the shaft bearing assembly 28 in the bearing block assembly 18. The angular orientation of the bearing block assembly 18 in FIG. 1 is perpendicular to the base unit 12. When the chain saw 21 is turned on and rotated clockwise in FIG. 1. A First cut is made in the timber 14. The first cut is parallel to the length of the timber 14. Then, the screws 17 are removed, and the base unit 12 is rotated 90 degrees so that the length of the base unit 12 is perpendicular to the length of the timber 14. Then, the screws 17 are re-installed to secure the base unit 12 to the timber 14. In this orientation, the chain saw 21 makes a second cut that is perpendicular to the length of the timber 14. The first cut and the second cut intersect, and a block of timber falls away from the end leaving a tenon.

The length of the tenon is controlled by the positioning of the length of the base unit 12, as shown in FIG. 1, parallel to the length of the timber 14. When the base unit 12 is positioned farther back from the end of the timber 14, then the length of the tenon is made longer. Similarly, when the base unit 12, as shown in FIG. 2, is positioned farther back from a side of the timber 14, then the width of the tenon is increased. Although not specifically illustrated in the drawings, cuts has angular orientations other than 90 degrees can be made by loosening the lock bolt 44, tilting the bearing block assembly 18, and retightening then lock bolt 44. A 45 degree angle cut can be made to serve as a miter cut. Therefore, the compound miter jig apparatus 10 of the invention provides compound variations; that is, variations in length, width, and angularity of cuts to the timber 14.

The base unit 12 includes a component-support portion 31 which supports the pair of pivot support assemblies 16 and the lock block 42 and includes a base extension portion 33 which extends away from the component-support portion 31. The base extension portion 33 gives the compound miter jig apparatus 10 of the invention greater versatility in attachment to a timber 14 and greater versatility in making longer or shorter cuts either parallel to the length of the timber 14 or perpendicular to the length of the timber 14.

The components of the compound miter jig apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved compound miter jig apparatus that is low in cost, relatively simple in design and operation, and which may advantageously be used to guide a chain saw in a range of non-perpendicular angles with respect to a longitudinal axis of a timber to be cut. With the invention, a compound miter jig apparatus is provided which guides the chain saw for partially cutting through ends of a timber. With the invention, a compound miter jig apparatus is provided which guides the chain saw for producing a tenon at the end of a timber. With the invention, a compound miter jig apparatus is provided which readily attaches to a large timber. With the invention, a compound miter jig apparatus is provided which connects to a hole in the guide frame that is in the proximity of the drive mechanism for the chain of a chain saw. With the invention, a compound miter jig apparatus is provided which can be used to guide a chain saw to provide tenons of a variety of lengths and a variety of thicknesses.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A compound miter jig apparatus, comprising:

a base unit, a plurality of connecting means for connecting said base unit to an article to be cut, a pair of pivot support assemblies connected to said base unit, wherein said pivot support assemblies are spaced apart from each other on said base unit, wherein said pivot support assemblies include longitudinally adjustable first pivot elements, a bearing block assembly supported by said first pivot elements and located between said first pivot elements, wherein said bearing block assembly includes a pair of second pivot elements in contact with said first pivot elements, wherein said bearing block assembly includes a shaft bearing assembly, a shaft assembly supported by said shaft bearing assembly, wherein said shaft assembly includes a chain-saw-connector assembly, and an adjustable tilt-lock assembly supported by said base unit and connected to said bearing block assembly for locking said bearing block assembly at a predetermined angular tilt.

2. The apparatus of claim 1 wherein said connecting means include:

a plurality of orifices in said base unit, and a plurality of fasteners which are passed through said orifices and into the article.

3. The apparatus of claim 1 wherein:

said first pivot elements include conical first pivot bearing surfaces, and said second pivot elements include second bearing surfaces which are complementarily shaped to contact said first pivot bearing surfaces.

4. The apparatus of claim 1 wherein said flit-lock assembly includes:

a first link pivotally connected to said bearing block assembly, a second link pivotally connected to said first link, a lock block pivotally connected to said second link, and a lock bolt connected to said lock block and contacting said second link, such that, by screwing said lock bolt into said lock block, said second link is fixed to a predetermined position with respect to said lock block.

5. The apparatus of claim 4 wherein:

said second link includes a ruled surface, and said lock block includes a pointer element adjacent to said ruled surface for pointing to markings on said ruled surface.

6. The apparatus of claim 4 wherein:

said second link includes a guide channel, and said lock block includes a channel cam for riding in said guide channel.

7. The apparatus of claim 4 wherein said base unit includes a component-support portion which supports said pair of pivot support assemblies and said lock block and includes a base extension portion which extends away from said component-support portion.

8. The apparatus of claim 1 wherein each of said pivot support assemblies includes:

a longitudinal adjustment assembly for adjusting the contact of the first pivot elements with the second pivot elements.

9. The apparatus of claim 8 wherein each longitudinal adjustment assembly includes an internally threaded barrel portion and an externally threaded shaft portion that screws into and out of said barrel portion.

10. The apparatus of claim 1 wherein said chain-saw-connector assembly includes:

a first collar connected to said shaft assembly, a threaded bolt projecting from said first collar, a second collar supported by said threaded bolt, and a lock nut screwed onto said threaded bolt.

11. The apparatus of claim 1 wherein said bearing block assembly includes a split portion and a compression bolt for controlling clamping pressure for moving ends of the bearing block assembly adjacent to said split portion toward each other.

* * * * *